US008618037B2

(12) United States Patent
Schacht et al.

(10) Patent No.: US 8,618,037 B2
(45) **Date of Patent: *Dec. 31, 2013**

(54) AQUEOUS ACID CLEANING, CORROSION AND STAIN INHIBITING COMPOSITIONS IN THE VAPOR PHASE COMPRISING A BLEND OF NITRIC AND SULFURIC ACID

(75) Inventors: Paul F. Schacht, Oakdale, MN (US); Eric V. Schmidt, Woodbury, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/344,119

(22) Filed: Jan. 5, 2012

(65) Prior Publication Data

US 2012/0172277 A1 Jul. 5, 2012

Related U.S. Application Data

(63) Continuation-in-part of application No. 12/984,670, filed on Jan. 5, 2011, now abandoned.

(51) Int. Cl.
*C11D 17/00* (2006.01)

(52) U.S. Cl.
USPC ..... 510/218; 510/426; 510/428; 134/18

(58) Field of Classification Search
None
See application file for complete search history.

(56) References Cited

U.S. PATENT DOCUMENTS

| | | | |
|---|---|---|---|
| 3,668,137 | A | 6/1972 | Gardner |
| 3,752,169 | A | 8/1973 | Rauch, Jr. |
| 3,887,488 | A | 6/1975 | Scott |
| 4,154,791 | A | 5/1979 | Howells |
| 4,356,148 | A | 10/1982 | Kagawa |
| 4,539,140 | A | 9/1985 | Quinlan |
| 5,925,606 | A | 7/1999 | Stamm |
| 6,200,947 | B1 | 3/2001 | Takashima |
| 6,218,349 | B1 | 4/2001 | Kravitz et al. |
| 6,540,943 | B1 | 4/2003 | Treybig et al. |
| 6,617,290 | B2 | 9/2003 | Lopes |
| 6,953,772 | B2 | 10/2005 | Lopes |
| 7,494,963 | B2 | 2/2009 | Ahmed et al. |
| 7,501,027 | B2 | 3/2009 | Ahmed et al. |
| 2002/0039981 | A1 | 4/2002 | Lopes |
| 2003/0235623 | A1 | 12/2003 | Van Oosterom |
| 2006/0035808 | A1 | 2/2006 | Ahmed et al. |
| 2006/0046945 | A1 | 3/2006 | Herdt et al. |
| 2006/0280810 | A1 | 12/2006 | Kross |

(Continued)

FOREIGN PATENT DOCUMENTS

| | | |
|---|---|---|
| EP | 1311653 B1 | 5/2004 |
| EP | 1561801 A1 | 8/2005 |

(Continued)

OTHER PUBLICATIONS

LaQue, F.L. and Copson, H.R., "Corrosion Resistance of Metals and Alloys", Second Edition, American Chemical Society Monograph Series, Reinhold Publishing Corporation, New York, p. 393-395.

*Primary Examiner* — Necholus Ogden, Jr.
(74) *Attorney, Agent, or Firm* — Andrew D. Sorensen; Shaoni L. Mitchell

(57) ABSTRACT

The present invention relates to sulfuric/nitric blended acid cleaners which employ the use of ethoxylated amines and/or ethoxylated alcohols as a corrosion and stain inhibitor in the vapor phase for cleaning metal and other surfaces, particularly stainless steel. Method of use and manufacturing of the same are also disclosed.

18 Claims, 3 Drawing Sheets

(56) References Cited

U.S. PATENT DOCUMENTS

| | | | |
|---|---|---|---|
| 2008/0015134 | A1 | 1/2008 | Ahmed et al. |
| 2008/0319070 | A1 | 12/2008 | Kany |
| 2009/0050179 | A1 | 2/2009 | Kang et al. |

FOREIGN PATENT DOCUMENTS

| | | | |
|---|---|---|---|
| EP | 1263918 | | 11/2005 |
| EP | 1693437 | A1 | 8/2006 |
| EP | 1693437 | A4 | 12/2007 |
| EP | 1709145 | B1 | 6/2009 |
| GB | 917432 | | 2/1963 |
| KR | 10-0305693 | | 10/2001 |
| KR | 10-0306153 | | 11/2001 |
| KR | 10-0395135 | | 6/2004 |
| KR | 10-0696928 | | 3/2007 |
| WO | WO01/70921 | A2 | 9/2001 |
| WO | WO01/70921 | A3 | 12/2001 |
| WO | WO02/10325 | A1 | 2/2002 |
| WO | WO02/10325 | A8 | 4/2002 |
| WO | WO2005/073359 | | 8/2005 |
| WO | WO2006/020608 | A2 | 2/2006 |
| WO | WO2006/020608 | A3 | 10/2006 |
| WO | WO2007/050291 | | 5/2007 |
| WO | WO2007/128345 | | 11/2007 |
| WO | WO2008/022650 | | 2/2008 |
| WO | WO2009/059630 | | 5/2009 |
| WO | WO 2009/059630 | * | 5/2009 |

* cited by examiner

AQUEOUS ACID CLEANING, CORROSION AND STAIN INHIBITING COMPOSITIONS IN THE VAPOR PHASE COMPRISING A BLEND OF NITRIC AND SULFURIC ACID

CROSS-REFERENCE TO RELATED APPLICATIONS

This application claims priority and is related to U.S. application Ser. No. 12/984,670 filed on Jan. 5, 2011 and entitled "Aqueous Acid Cleaning, Corrosion and Stain Inhibiting Compositions in the Vapor Phase Comprising a Blend of Nitric and Sulfuric Acid." The entire contents of this patent application are hereby expressly incorporated herein by reference including, without limitation, the specification, claims, and abstract, as well as any figures, tables, or drawings thereof.

FIELD OF THE INVENTION

The present invention relates to aqueous acid cleaners for cleaning metal and other surfaces, particularly stainless steel and for inhibiting both staining and corrosion in the vapor phase. Method of use and manufacturing of the same are also disclosed.

BACKGROUND

Steel is the generic name for a group of ferrous metals, composed principally of iron, which have considerable durability and versatility. By the proper choice of carbon content, addition of alloying elements, and by suitable heat treatment, different kinds of steel can be made for various purposes and the use in industry of all kinds of steel is now quite expansive.

Stainless steel (SS) is defined as a steel alloy, with a minimum of 11% chromium content by mass. Stainless steel does not stain, corrode, or rust as easily as traditional steel. There are over 150 different grades and surface finishes to allow the stainless steel to suit the environment in which it will be used. Stainless steel's low maintenance and relatively low cost make it an ideal base material for many commercial applications. It is used in cookware, cutlery, hardware, surgical instruments, major appliances, industrial equipment, food and beverage processing industry equipment, it is also used as a structural alloy for cars and as a construction material for buildings.

Stainless steels have a passive film of chromium oxide that forms in the presence of oxygen due to the chromium present in the steel. This layer blocks most corrosion from spreading into the metal's internal structure. Higher corrosion resistance can be achieved with chromium additions of 13% by weight up to 26% for harsh environments. The chromium forms a passive layer of chromium III oxide ($Cr_2O_3$) when exposed to oxygen. To have their optimum corrosion resistance, stainless steel surfaces must be clean and have an adequate supply of oxygen to maintain this passive surface layer.

Cleaning of stainless steel includes the removal of various surface contaminants to ensure corrosion resistance, to prevent contamination, and to achieve the desired appearance of the steel. Acid cleaning is a process by which a solution of a mineral or organic acid in water sometimes in combination with a wetting agent or detergent or both, is employed to remove iron and other metallic contamination, light oxide films, soil and similar contaminants.

Acid cleaning compositions for removing contaminants from stainless steel generally have the mineral or organic acid in a solution with a pH of less than 7.0. The compositions can remove both organic and inorganic soils in the same operation. They also are used to improve corrosion resistance and enhance brightness or gloss of the base metal surface.

One of the problems which arise in the use of steel is its corrosion, either by the atmosphere or by the environment in which it is used. The rate of corrosion may vary, depending on the surrounding conditions and also the composition of the steel. Stainless steel, especially, is much more resistant to corrosion than plain carbon and other steels. This resistance is due to the addition of chromium and other metals to this alloy, specifically stainless steel. Although stainless steel has appreciable resistance to corrosion, it will still corrode in certain circumstances and attempts have been made to prevent or reduce this corrosion. Most acid cleaners also include a corrosion inhibitor of some sort. For example, in acid media copper sulphate has been used as a corrosion inhibitor. However this and other proposed inhibitors are not entirely satisfactory since, like copper sulphate, they may be expensive, introduce an effluent disposal problem and, moreover, are not entirely effective. For example, when copper containing urea sulfuric solutions are placed in contact with nickel metal, copper will plate the nickel surface.

A variety of compounds, including dialkylthioureas, such as diethylthiourea and dibutylthiourea, are known to reduce the corrosivity of sulfuric acid to carbon steels. Thioureas are not appropriate for food and beverage situations as some of them have been found to be carcinogenic and any remnant thioreas compounds are considered contamination for such surfaces.

The type of acid used has also presented problems in development of acid cleaners. Many acid cleaners are based upon phosphoric acid due to its diverse functionality such as a low corrosion profile on many alloys and elastomers, good mineral solubility and good soil suspension properties. Many acid cleaners are also based on high levels of nitric acid due to its compatibility with a variety of materials as well as its effectiveness at mineral soil solubility and removal, however, high nitric acid based cleaners can cause vapor staining and corrosion to stainless steel due to the volatile airborne nitrogen oxides.

Phosphoric acid and nitric acid continue to have more strict effluent regulations due to the phosphorus and nitrate environmental and drinking water issues. It is therefore an object of this invention to provide a phosphorous free and reduced nitric acid based cleaning composition which has equal or superior cleaning, corrosion and vapor stain inhibiting properties as other phosphoric and nitric acid based cleaners on some varieties of stainless steel, such as the 300 series.

It is also an object of this invention to provide sulfuric/nitric blended acid cleaning compositions which are used at higher temperatures and which are relatively noncorrosive and stain inhibiting in the vapor phase to stainless steel due to addition of an ethoxylated amine and/or an ethoxylated alcohol.

Other objects, aspects and advantages of this invention will be apparent to one skilled in the art in view of the following disclosure, the examples, and the appended claims.

SUMMARY OF THE INVENTION

The present invention employs the use of an ethoxylated amine and/or an ethoxylated alcohol as a corrosion inhibitor for use in sulfuric/nitric acid blended cleaning compositions. Applicants have found, surprisingly that the combination of ethoxylated amines and/or ethoxylated alcohols as a corrosion and stain inhibitors in an acidic cleaning solution reduce and/or inhibit vapor phase staining and corrosion. The invention employs an aqueous solution of a pH of less than 7, which uses an acid as the cleaning component. Any acid used in an acid cleaning composition may be combined with an ethoxylated amine and/or ethoxylated alcohol according to the invention, such as acetic acid, citric acid, oxalic acid, sulfuric acid, and nitric acid all of which are traditionally used in acid cleaning compositions. In a preferred embodiment, the acid cleaning solution is a blend of nitric acid and sulfuric acid. The acid cleaning compositions of the invention retain the anti-corrosive and improve anti-staining properties of phosphoric acid as well as the cleaning capabilities while eliminating phosphorus and reducing nitric acid to improve the environmental profile while providing a less expensive product.

Typical sulfuric/nitric blended acid cleaners contain from about 1 to about 30 weight percent, or about 5 to about 25 weight percent sulfuric acid; from about 1 to about 25 weight percent, or about 5 to 15 weight percent nitric acid; and about 1 to about 80 weight percent water. Nitric and sulfuric acid, in combination, constitute at least about 5 to about 50 weight percent nitric acid and about 1 to about 30 weight percent sulfuric acid.

According to the invention for a concentrated solution, nitric and sulfuric acid, in combination, constitute at least about 5 to about 50 weight percent nitric acid and about 1 to about 30 weight percent sulfuric acid. The ethoxylated amine and/or ethoxylated alcohol then, can be from about 0.05 to about 5 weight percent of the composition, with the remainder being water, specifically about 1 to about 80 weight percent.

In some embodiments, nitric acid is present in the compositions at at least about 5 to about 50 weight percent, or about 5 to about 25 weight percent. In other embodiments, sulfuric acid is present in the compositions at at least about 1 to about 30 weight percent. It is theorized that the nitric acid protects the surface of the stainless steel metal from the more corrosive sulfuric acid due to its oxidizing characteristics allowing the continuous formation of the passive chromium oxide film. This also makes the composition less expensive and retains the low corrosivity and cleaning properties of phosphoric and nitric containing acid based cleaners. Applicants have found that addition of a corrosion inhibitor including ethoxylated amines and/or ethoxylated alcohols work surprisingly well in acidic cleaning compositions to minimize the staining and corrosion of steel in the vapor phase that is often found in high nitric acid containing solutions.

The compositions of this invention can be produced by first mixing sulfuric acid and nitric acid and, optionally water, by either batch or continuous processes, to which the ethoxylated amine and/or ethoxylated alcohol is later added. While not wishing to be bound by any theory, it is postulated that the ethoxylated alcohols as well as other such ethoxylated surfactants which are intended to be within the scope of the invention, being less water soluble at higher temperatures, oil out of solution and form an oily layer on top of the solution that minimizes the release of acidic vapors that corrode and stain the stainless steel. Furthermore, it is postulated that the ethoxylated amines volatilize at high temperatures and protect the stainless steel surface by forming a barrier via adsorption of the amine group to the metal surface.

While multiple embodiments are disclosed, still other embodiments of the present invention will become apparent to those skilled in the art from the following detailed description, which shows and describes illustrative embodiments of the invention. Accordingly, the detailed description is to be regarded as illustrative in nature and not restrictive.

FIGURES

DETAILED DESCRIPTION OF THE PREFERRED EMBODIMENTS

Figure 1:
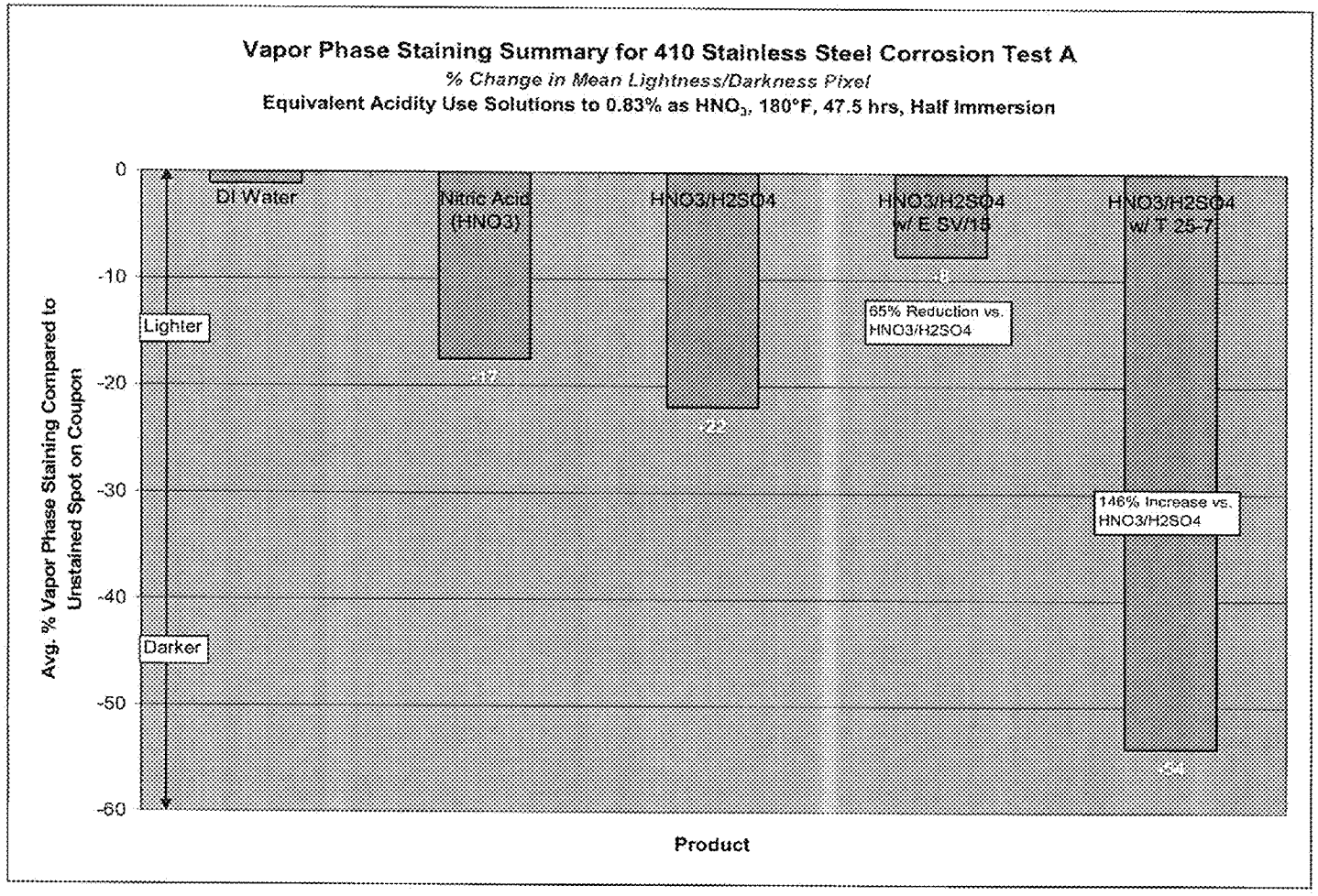
FIG. 1 illustrates the vapor phase staining summary for a 410 stainless steel corrosion test performed at 180 degrees Fahrenheit.

So that the invention maybe more readily understood, certain terms are first defined and certain test methods are described.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

As used herein, the term "phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than 0.5 wt. %. More preferably, the amount of phosphorus is less than 0.1 wt-%, and most preferably the amount of phosphorus is les than 0.01 wt. %.

"Cleaning" means to perform or aid in soil removal, bleaching, microbial population reduction, rinsing, or combination thereof.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g. 1 to 5 includes 1, 1.5, 2, 2.75, 3, 3.80, 4, and 5).

In some aspects, the present disclosure relates to phosphorous free acid cleaning compositions which may be used in place of traditional phosphoric and nitric acid cleaning compositions, which retain the cleaning and anti-corrosive properties while improving the anti-staining properties of the same and are less expensive to produce. The compositions will find use in any cleaning situation where phosphoric and nitric containing acid based cleaners can be used, including, but not limited to, stainless steel.

Stainless steels are generally classified as carbon steels containing at least about 5 weight percent, usually about 5 to about 40 weight percent, and normally about 10 to about 25 weight percent chromium. They may also contain other alloying elements such as nickel, cerium, aluminum, titanium, copper, or other elements.

Stainless steels are usually classified in three different categories—austenitic, ferritic, and martensitic steels—which have in common the fact that they contain significant amounts of chromium and resist corrosion and oxidation to a great extent than do ordinary carbon steels and most alloy steels.

Austenitic stainless steels or 300 series, make up about 70% of stainless steel production and are the most common alloys of this group. They contain a maximum of 0.25% carbon, a minimum of 16% chromium and sufficient nickel and manganese to retain an austenitic structure at all temperatures from the cryogenic region to the melting point of the alloy. A typical composition of 18% chromium and 10% nickel, commonly known as 18/10 stainless, is often used in flatware. AISI types 302, 303, 304, and 316 are several of the more extensively used austenitic stainless steels.

Ferritic stainless steels are highly corrosion-resistant, but less durable than austenitic grades. They are generally characterized, in part, by the fact that they contain chromium only (in addition to the other components of carbon steel) or only very minor amounts of alloying elements. Martensitic stainless steels are not as corrosion-resistance as the other two classes but are extremely strong and tough, as well as highly machineable, and can be hardened by heat treatment. Martensitic stainless steel contains chromium (about 12-14%), molybdenum (about 0.2-1%), nickel (about 0-2%), and carbon (about 0.1-1%) (giving it more hardness but making the material a bit more brittle). It is quenched and magnetic.

Stainless Steel Grades

The SAE steel grades are the most commonly used grading system in the US for stainless steel.

300 Series—Austenitic Chromium-Nickel Alloys

- Type 301—highly ductile, for formed products. Also hardens rapidly during mechanical working. Good weldability. Better wear resistance and fatigue strength than 304
- Type 302—same corrosion resistance as 304, with slightly higher strength due to additional carbon
- Type 303—free machining version of 304 via addition of sulfur and phosphorus
- Type 304—the most common grade; the classic 18/8 stainless steel
- Type 304L—same as the 304 grade but contains less carbon to increase weldability and is slightly weaker than 304.
- Type 304LN—same as 304L, but also nitrogen is added to obtain a much higher yield and tensile strength than 304L
- Type 308—used as the filler metal when welding 304
- Type 309—better temperature resistance than 304, also sometimes used as filler metal when welding dissimilar steels, along with inconel
- Type 316—the second most common grade (after 304); for food and surgical stainless steel uses; alloy addition of molybdenum prevents specific forms of corrosion. It is also knows as marine grade stainless steel due to its increased resistance to chloride corrosion compared to type 304. 316 is often used for building nuclear reprocessing plants.
- Type 316L—extra low carbon grade of 316, generally used in stainless steel watches and marine applications due to its high resistance to corrosion. Also referred to as "A4" in accordance with ISO 3506.
- Type 316 Ti—includes titanium for heat resistance, therefore it is used in flexible chimney liners.
- Type 321—similar to 304 but lower risk of weld decay due to addition of titanium. See also 347 with addition of niobium for desensitization during welding.

400 Series—Ferritic and Martensitic Chromium Alloys

- Type 405—ferritic for welding applications
- Type 408—heat resistant; poor corrosion resistance; 11% chromium, 8% nickel
- Type 409—cheapest type; used for automobile exhausts; ferritic (iron/chromium only)
- Type 410—martensitic (high-strength iron/chromium). Wear resistant, but less corrosion resistant.
- Type 416—easy to machine due to additional sulfur
- Type 420—Cutlery Grade martensitic; similar to the Brearley's original rustless steel. Excellent polishability.
- Type 430—decorative, e.g., for automotive trim; ferritic. Good formability, but with reduced temperature and corrosion resistance.
- Type 439—ferritic grade, a higher grade version of 409 used for catalytic converter exhaust sections. Increased chromium for improved high temperature corrosion/oxidation resistance.
- Type 440—a higher grade of cutlery steel, with more carbon, allowing for much better edge retention when properly heat-treated.
- Type 446—for elevated temperature service The acid cleaning compositions of the invention can be used in, including but not limited to the austenitic stainless steel surfaces mentioned above. The absence of thiol compounds makes this cleaning composition acceptable for ware washing and cleaning of other surfaces that come into contact with food.

Clean in Place Procedures

The composition of the invention will also find use in removing mineral soils as well. In one embodiment the composition may be used on stainless steel pipes which need to use acid cleaners to de-lime surfaces including clean in place (i.e., CIP) applications where the cleaner is passed through the pipes without dissembling equipment.

Exemplary industries in which the methods of the present invention can be applied include, but are not limited to: the food and beverage industry, e.g., the dairy, cheese, sugar, and brewery industries; oil processing industry; industrial agriculture and ethanol processing; and the pharmaceutical manufacturing industry.

In some aspects, the methods of the present invention apply to equipment, e.g., industrial equipment, generally cleaned using clean in place cleaning procedures. Examples of such equipment include evaporators, heat exchangers (including tube-in-tube exchangers, direct steam injection, and plate-in-frame exchangers), heating coils (including steam, flame or heat transfer fluid heated) re-crystallizers, pan crystallizers, spray dryers, drum dryers, membranes and tanks.

Conventional CIP (clean-in-place) processes are generally well known. The process includes applying or circulating a water diluted solution of cleaning concentrate (typically about 0.5-3% by volume) onto the surface to be cleaned. The solution flows across the surface (3 to 6 feet/second) to remove the soil. Either new solution is re-applied to the surface, or the same solution is re-circulated and re-applied to the surface as required to achieve a clean soil-free surface.

A typical CIP process to remove a soil (including organic, inorganic or a mixture of the two components) often includes at least three steps: an initial water rinse or previously used chemical rinse, an alkaline and/or acid solution wash, and a final fresh water rinse. Additional steps may include a separate acid or alkaline wash as wall as a separate sanitizing step. The alkaline solution softens the soils and removes the organic alkaline soluble soils. The acid solution removes any remaining mineral soils. The strength of the alkaline and acid solutions, the duration of the cleaning steps and the cleaning solution temperature are typically dependent on the amount and tenacity of the soil. The water rinse removes any residual chemical solution and soils prior to the equipment being returned on-line for production purposes.

Ethoxylated Amines and/or Ethoxylated Alcohols

Amines are reacted with various amounts of ethylene oxide to ethoxylate the amines and to modify emulsification, surface tension, solubility and cationic strength properties of the base amines. Ethoxylated amines are represented by the formula

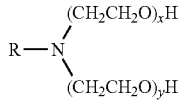

where R is the alkyl radical and x+y is 2, 5, 10, 15, or 50. Alkyl groups are commercially available at 10 to 18 carbon atoms. An example of a commercially available ethoxylated amine for use in the compositions includes, but is not limited to, Ethomeen® SV/15, commercially available from AkzoNobel.

Alcohols are treated with ethylene oxide to ethoxylate the alcohol and potassium hydroxide (KOH), which serves as a catalyst. The reactor is pressurized with nitrogen and heated to about 150° C. The reaction is shown below: ROH+n $C_2H_4O \rightarrow R(OC_2H_4)nOH$ wherein n is 5 to 10. An example of a commercially available ethoxylated alcohol is Tomadal® 25-7 from Air Products.

The present invention employs the use of ethoxylated amines and/or ethoxylated alcohols as a corrosion inhibitor for use in acid cleaning compositions including sulfuric acid and/or nitric acid. Typical sulfuric/nitric blended acid cleaners contain from about 1 to about 30 weight percent sulfuric acid, from about 5 to about 50 or from about 5 to about 25 weight percent nitric acid and about 1 to 80 weight percent water. Nitric and sulfuric acid, in combination, constitute at least about 1 to about 50 weight percent of the composition.

In some aspects, ethoxylated amines and/or ethoxylated alcohols are present in the acid concentrate compositions at at least about 0.05 to about 5 weight percent. The ethoxylated amines, ethoxylated alcohols and nitric acid protects the surface of the metal from the sulfuric acid, it makes the composition less expensive and retains the low corrosivity, low staining and cleaning properties of phosphoric containing acid based cleaners. Applicants have found that addition of a corrosion inhibitor including ethoxylated amines and/or ethoxylated alcohols works surprisingly well in acidic cleaning compositions.

The compositions of this invention can be produced by first mixing sulfuric acid and nitric acid and, optionally water, by either batch or continuous processes, to which the ethoxylated amine and/or ethoxylated alcohol is later added. While not wishing to be bound by any theory, it is postulated that the ethoxylated amines and ethoxylated alcohols as well as other such amines and alcohols which are intended to be within the scope of the invention, coat the surface of the steel to provide a protective coating which prevents the sulfuric/nitric blended acid from corroding the same, even in acidic environments.

Additives

In some aspects, the aqueous solutions in accordance with embodiments of the invention may also contain other components, if this appears to be desirable. In many cases it is advisable to add surfactants in order to encourage a simultaneous cleaning and degreasing effect, and to ensure satisfactory wetting of the surfaces being treated with the acid cleaning composition. The desired amount of the surfactants may be added directly to the treatment solution, but it is preferable to add them to the concentrate used in producing the solution.

In addition to the main components other additives may be added to the compositions depending upon the soils to be removed, the stainless steel or other material to be cleaned, the requiring inhibiting affects, the desired final surface properties and the waste disposal requirements and economic considerations. Other additives may also be included including but not limited to wetting agents to lower solution surface tension, solvents to aid in the removal of hydrophobic soils, defoamers to prevent foam or foam buildup on solution surface, thickeners (acid stable) to allow the cleaner to adhere (cling to vertical surface), passivators to protect the surface from environmental attack, and biocides to control odor problems and kill harmful bacteria. Dyes and other components may also be added.

The term "surfactant" or "surface active agent" refers to an organic chemical that when added to a liquid changes the properties of that liquid at a surface.

Aesthetic enhancing agents such as colorants and perfume are also optionally incorporated into the concentrate composition of the invention. Examples of colorants useful in the present invention include but are not limited to liquid and powdered dyes from Milliken Chemical, Keystone, Clariant, Spectracolors, and Pylam.

Examples of perfumes or fragrances useful in concentrate compositions of the invention include but are not limited to liquid fragrances from J&E Sozio, Firmenich, and IFF (International Flavors and Fragrances).

It should be understood that the water provided as part of the solution or concentrate can be relatively free of hardness. It is expected that the water can be deionized to remove a majority of the dissolved solids in the water. The concentrate is then diluted with water available at the locale or site of dilution and that water may contain varying levels of hardness depending upon the locale. Although deionized is preferred for formulating the concentrate, the concentrate can be formulated with water that has not been deionized. That is, the concentrate can be formulated with water that includes dissolved solids, and can be formulated with water that can be characterized as hard water.

Examples of useful ranges for the basic composition for the acid cleaning composition of the invention include those provided in Table 1, illustrated below:

TABLE 1

| Component | Weight Percent | Preferable Weight Percent |
|---|---|---|
| Sulfuric Acid | 1-30 | 15-25 |
| Nitric Acid | 5-50 | 5-25 |
| Ethoxylated Amine and/or Ethoxylated Alcohol | 0.05-5 | 0.05-5 |
| Water | 1-80 | 1-60 |
| Dye | Up to 1% | Up to 1% |
| Urea | Up to 5% | Up to 5% |
| Surfactant | Up to 5% | Up to 5% |

In an alternate embodiment, the acid cleaning composition can include the components at the amounts shown as provided in Table 2, illustrated below:

TABLE 2

| Component | Weight Percent | Preferable Weight Percent |
|---|---|---|
| Sulfuric Acid | 1-30 | 15-25 |
| Ethoxylated Amine and/or Ethoxylated Alcohol | 0.05-5 | 0.05-5 |
| Water | 1-80 | 1-60 |
| Dye | Up to 1% | Up to 1% |
| Urea | Up to 5% | Up to 5% |
| Surfactant | Up to 5% | Up to 5% |

In an another alternate embodiment, the acid cleaning composition can include the components in the amounts shown as provided in Table 3, illustrated below:

TABLE 3

| Component | Weight Percent | Preferable Weight Percent |
|---|---|---|
| Nitric Acid | 5-50 | 5-25 |
| Ethoxylated Amine and/or Ethoxylated Alcohol | 0.05-5 | 0.05-5 |
| Water | 1-80 | 1-60 |
| Dye | Up to 1% | Up to 1% |
| Urea | Up to 5% | Up to 5% |
| Surfactant | Up to 5% | Up to 5% |

The sulfuric-nitric/ethoxylated amine and/or ethoxylated alcohol acid compositions can be produced by the mixture of nitric and sulfuric acid and, optionally water, by either batch or continuous process with the addition of ethoxylated amines and/or ethoxylated alcohols and any other excipients thereafter.

Generally, during a clean in place process the concentrated formula is diluted with water to a specific concentration and heated to the desired temperature and re-circulated through the processing equipment. Without wishing to be bound by any particular theory, it is thought that the ethoxylated amines in the dilute cleaning solutions effectively inhibit vapor phase corrosion and staining of stainless steel at temperatures ranging from 40 degrees Fahrenheit to 200 degrees Fahrenheit. It is further thought that the ethoxylated alcohols in the dilute cleaning solution effectively inhibit vapor phase corrosion and staining of stainless steel at temperatures ranging from 40 degrees Fahrenheit to 160 degrees Fahrenheit.

In some aspects, use of acid cleaners may involve the use of an alkaline detergent cleaning product and water rinse, either prior to or after application of the acid cleaner followed by a subsequent water rinse.

The invention has been shown and described herein in what is considered to be the most practical and preferred embodiment. The applicant recognizes, however, that departures may be made therefrom within the scope of the invention and that obvious modifications will occur to a person skilled in the art. The examples which follow are intended for purposes of illustration only and are not intended to limit the scope of the invention. All references cited herein are hereby incorporated in their entirety by reference.

EXAMPLES

Metal Alloy Corrosion Test Method

The following test method describes an accepted, but not exclusive, procedure for metal alloy corrosion testing based on ASTM Methods such as ASTM G1 and ASTM G31.

1. Obtain coupons, clean, passivate, measure surface area and weigh the coupons prior to corrosion tests.
2. Subject the coupons to the corrosive environment for a period of time dependent on the particular test purpose.
3. At the end of the test, thoroughly rinse the coupons, dry, re-weigh and calculate the MPY (mil inch per year) according to the following calculation:

$$\text{MPY}=(534568\times\text{grams weight loss})/(\text{inches}^2\text{ average surface area}\times\text{hours time}\times\text{grams/centimeters}^3\text{ metal alloy density}). \quad \text{a.}$$

General Test Procedure for Pixel Analysis for Stained Stainless Steel Coupons

1. Scan the coupons using a scanner.
2. Use ImageJ software to create a gray scale histogram of the scanned coupon.
3. Calculate the mean of the gray scale histogram for each area on the coupon that is of interest, i.e. the histogram pixel analysis of a coupon's vapor phase stained area can be compared to a non-stained histogram of another area or coupon to calculate a percent difference.

Corrosion Test Results

A vapor phase corrosion test was performed using the metal alloy corrosion test described above on 410 stainless steel coupons, using an equivalent acidity use solution to 0.83% $HNO_3$ at 180 degrees Fahrenheit. The stainless steel coupons were half immersed into the test solution for 47.5 hours. The level of vapor phase staining was determined in comparison to an unstained spot on the stainless steel coupon using histogram pixel analysis. A value of "0" indicates an unstained stainless steel coupon whereas a negative number indicates a more stained stainless steel coupon. The results can be seen in FIG. 1 and Table 4 below.

TABLE 4

| Stainless Steel Coupon | Solution | Avg. % Vapor Phase Staining | Avg. % Change of Vapor Phase Staining in comparison to nitric acid/ sulfuric acid solution |
|---|---|---|---|
| 1 | Deionized Water | −1 | |
| 2 | Nitric Acid | −17 | |
| 3 | Nitric Acid/Sulfuric Acid | −22 | |
| 4 | Nitric Acid/Sulfuric Acid with an Ethoxylated Amine | −8 | 65% reduction |
| 5 | Nitric Acid/Sulfuric Acid with an Ethoxylated Alcohol | −54 | 146% increase |

Stainless steel coupon #1 was immersed in a deionized water solution bath and showed relatively no vapor staining based on the histogram pixel analysis resulting in a −1% change vs. a non-stained coupon histogram pixel analysis. Stainless steel coupon #2 was immersed in a nitric acid solution bath and showed an increased amount of staining as compared to coupon #1 (deionized water). Stainless steel coupon #3 was immersed in a nitric acid/sulfuric acid solution bath and showed even more staining as compared to coupon #1 (deionized water) and coupon #2 (nitric only). Stainless steel coupon #4 was immersed in a nitric acid/sulfuric acid solution bath with an added ethoxylated amine. The stain was slightly greater than coupon #1 (deionized water), but significantly less than coupon #2 (nitric only) and coupon #3 (nitric/sulfuric). Comparing the vapor staining histogram pixel analysis of coupon #4 (nitric/sulfuric/ethoxylated amine) to coupon #3 (nitric/sulfuric) shows a 65% reduction in vapor phase staining and corrosion. Without wishing to be bound by any particular theory, it is thought that the addition of the ethoxylated amine resulted in a decrease in the vapor phase staining of the nitric/sulfuric acid blend. Lastly, stainless steel coupon #5 was immersed in a nitric acid/sulfuric acid solution bath with the addition of an ethoxylated alcohol. At 180 degrees Fahrenheit, the ethoxylated amine was not effective at inhibiting the vapor phase staining of the nitric/sulfuric blend. The results from this test clearly indicate that an ethoxylated amine is an effective vapor stain and corrosion inhibitor for a 410 stainless steel surface at a higher temperature range.

Figure 2:
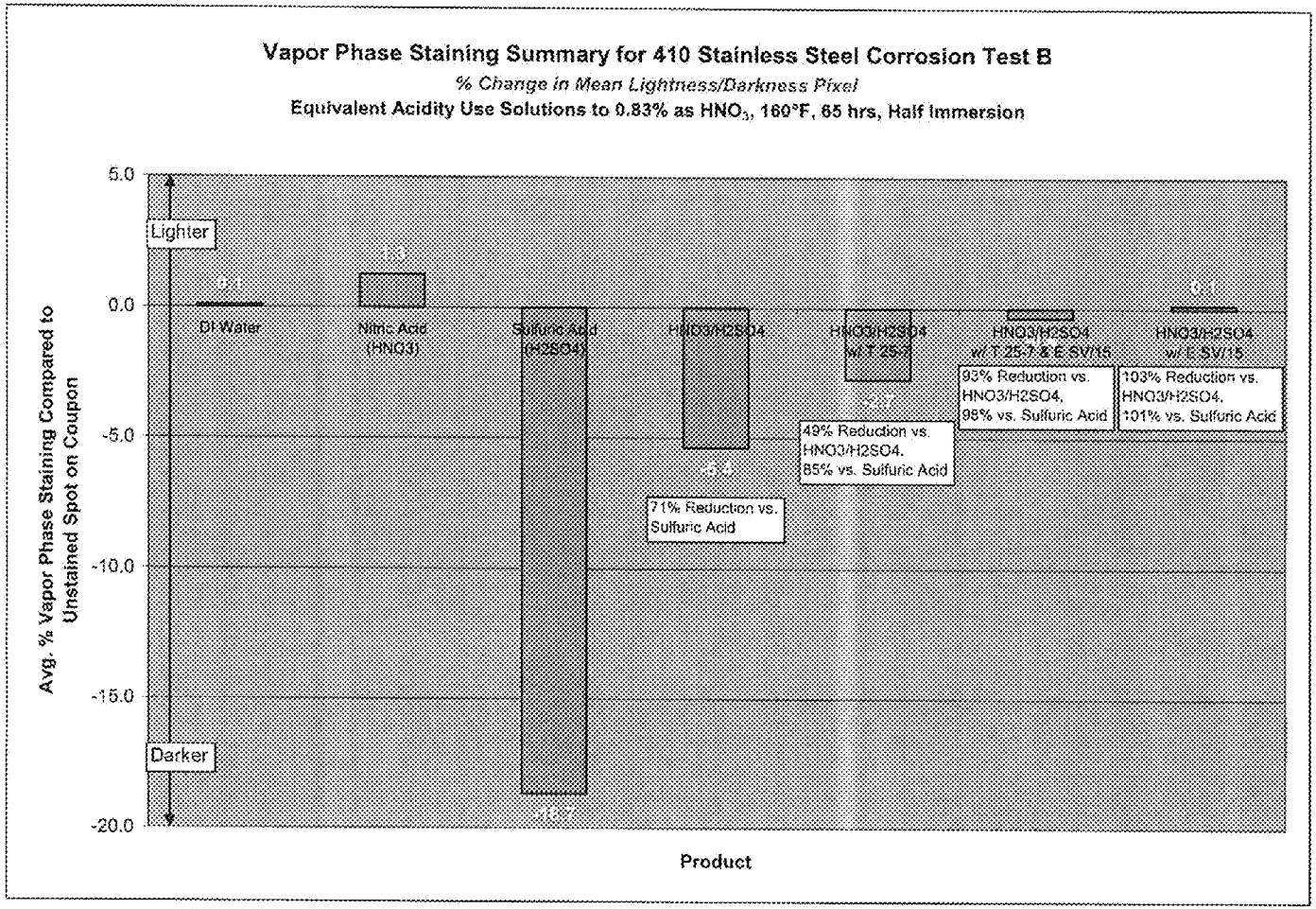
FIG. 2 illustrates the vapor phase staining summary for a 410 stainless steel corrosion test performed at 160 degrees Fahrenheit.

A second test was run using the metal alloy corrosion test method described above to measure the vapor phase staining of a 410 stainless steel coupon with various test compositions at 160 degrees Fahrenheit. The vapor phase corrosion test was performed with an equivalent acidity use solution to 0.83% $HNO_3$ at 160 degrees Fahrenheit. The stainless steel coupons were half immersed in the test solutions for 65 hours. The results of this test are shown in FIG. 2 and Table 5 below.

TABLE 5

| Stainless Steel Coupon | Solution | Avg. % Vapor Phase Staining | Avg. % Change in Vapor Phase Staining in comparison to nitric acid/sulfuric acid solution | Avg. % Change in Vapor Phase Staining in comparison to sulfuric acid solution |
|---|---|---|---|---|
| 1 | Deionized Water | 0.1 | 102% Reduction | 101% reduction |
| 2 | Nitric Acid | 1.3 | 124% Reduction | 107% reduction |
| 3 | Sulfuric Acid | −18.7 | 246% Increase | N/A |
| 4 | Nitric Acid/Sulfuric Acid | −5.4 | N/A | 71% reduction |
| 5 | Nitric Acid/Sulfuric Acid with an ethoxylated alcohol | −2.7 | 49% reduction | 85% reduction |
| 6 | Nitric Acid/Sulfuric Acid with an ethoxylated amine and an ethoxylated alcohol | −0.4 | 93% reduction | 98% reduction |
| 7 | Nitric Acid/Sulfuric Acid with an ethoxylated amine | 0.1 | 103% reduction | 101% reduction |

Stainless steel coupons #1 (deionized) and #2 (nitric only) showed relatively little to no vapor staining or corrosion based on the histogram pixel analysis. However, stainless steel coupon #3 (sulfuric only) showed a relatively high level of vapor staining. Stainless steel coupon #4 (nitric/sulfuric) showed a 71% reduction in staining and corrosion in comparison to the stainless steel coupon #3 (sulfuric only). Stainless steel coupon #5 (nitric/sulfuric/ethoxylated alcohol) was immersed in a mixture of nitric acid and sulfuric acid solution with an added vapor phase staining and corrosion inhibitor, specifically an ethoxylated alcohol. This mixture resulted in a 49% reduction in vapor staining in comparison to coupon #4 (nitric/sulfuric) and a 85% reduction in vapor staining in comparison to coupon #3 (sulfuric only). Stainless steel coupon #6 (nitric/sulfuric/ethoxylate alcohol/ethoxylated amine) was immersed in a mixture of nitric acid and sulfuric acid solution with two added corrosion inhibitors, specifically an ethoxylated amine and an ethoxylated alcohol. Coupon #6 had a 93% reduction in vapor staining in comparison to coupon #4 (nitric/sulfuric) and a 98% reduction in staining and corrosion in comparison to coupon #3 (sulfuric only). Finally, stainless steel coupon #7 (nitric/sulfuric/ethoxylated amine) was immersed in a mixture of nitric acid and sulfuric acid solution with an added vapor phase staining and corrosion inhibitor, specifically an ethoxylated amine. Coupon #7 had a 103% reduction in vapor staining in comparison to coupon #4 (nitric/sulfuric) and a 101% reduction in vapor to coupon #3 (sulfuric only). This test illustrates that both an ethoxylated amine and/or an ethoxylated alcohol are highly effective vapor stain and corrosion inhibitors for 410 stainless steel at temperatures as high as 160 degrees Fahrenheit.

Figure 3:
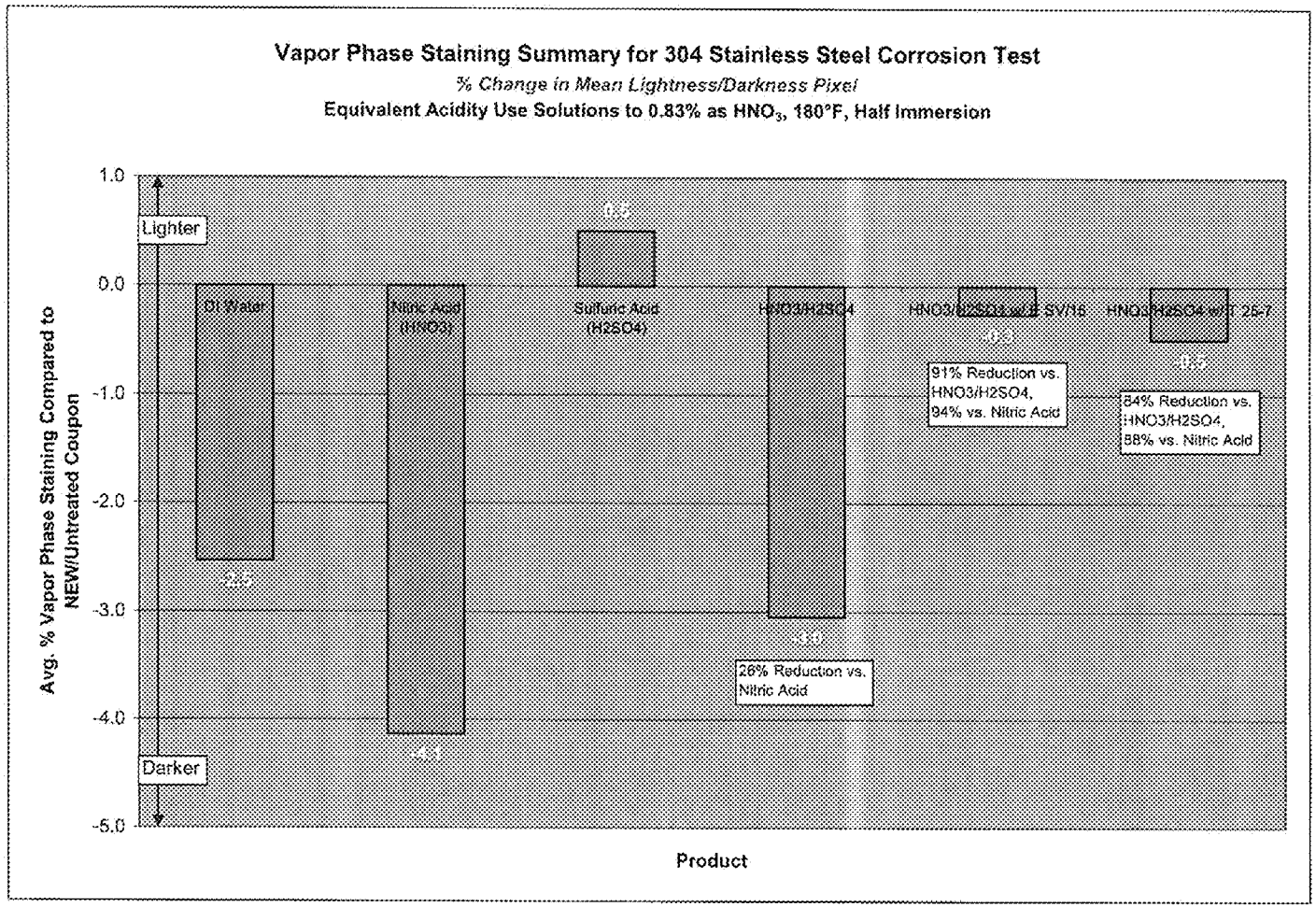
FIG. 3 illustrates the vapor phase staining summary for a 304 stainless steel corrosion test performed at 180 degrees Fahrenheit.

A third test was run using the metal alloy corrosion test method described above to measure the vapor phase staining of a 304 stainless steel coupon with various test compositions at 180 degrees Fahrenheit. The vapor phase corrosion test was performed with an equivalent acidity use solution to 0.83% $HNO_3$ at 180 degrees Fahrenheit. The stainless steel coupons were half immersed into the test solution for approximately 300 hours. The level of vapor phase staining was determined in comparison to an unstained spot on the stainless steel coupon using histogram pixel analysis. A value of "0" indicates an unstained stainless steel coupon whereas a negative number indicates a more stained stainless steel coupon. The results are shown in FIG. 3 and Table 6 (below).

TABLE 6

| Stainless Steel Coupon | Solution | Avg. % Vapor Phase Staining | Avg. % Change in Vapor Phase Staining in comparison to nitric acid solution | Avg. % Change of Vapor Phase Staining in comparison to nitric acid/ sulfuric acid solution |
|---|---|---|---|---|
| 1 | Deionized Water | −2.5 | 39% reduction | 17% reduction |
| 2 | Nitric Acid | −4.1 | N/A | 37% increase |
| 3 | Sulfuric Acid | 0.5 | 112% reduction | 117% reduction |
| 4 | Nitric Acid/ Sulfuric Acid | −3.0 | 26% reduction | N/A |
| 5 | Nitric Acid/ Sulfuric Acid with an ethoxylated amine | −0.3 | 94% reduction | 91% reduction |
| 6 | Nitric Acid/ Sulfuric Acid with an ethoxylated alcohol | −0.5 | 88% reduction | 84% reduction |

As can be seen from these results, stainless steel coupon #1 (deionized water) and #3 (sulfuric only) showed relatively little to no vapor staining or corrosion. However, stainless steel coupon #2 (nitric only) did show mild vapor staining. Stainless steel coupon #4 (nitric/sulfuric) was immersed in a mixture of nitric acid and sulfuric acid and showed a 26% reduction in vapor staining in comparison to coupon #2 (nitric only). Stainless steel coupon #5 (nitric/sulfuric/ethoxylated amine) was immersed in a mixture of nitric acid and sulfuric acid solution with an added corrosion inhibitor, specifically an ethoxylated amine, and showed a 91% reduction in vapor staining in comparison to coupon #4 (nitric/sulfuric) and a 94% reduction in vapor staining in comparison to coupon #2 (nitric only). Finally, stainless steel coupon #6 (nitric/sulfuric/ethoxylated alcohol) was immersed in a mixture of nitric acid and sulfuric acid solution with an added corrosion inhibitor, specifically an ethoxylated alcohol. Coupon #6 had a 84% reduction in vapor staining in comparison to coupon #4 (nitric/sulfuric) and a 88% reduction in vapor staining in comparison to coupon #2 (nitric only). This test illustrates that both an ethoxylated amine and/or an ethoxylated alcohol are highly effective vapor stain and corrosion inhibitors for 304 stainless steel, particularly at temperatures as high as 180 degrees Fahrenheit.

Obviously, many modifications and variations of the invention as hereinbefore set forth can be made without departing from the spirit and scope thereof, and, therefore, only such limitations should be imposed as are indicated by the appended claims.

What is claimed is:

1. A method of inhibiting vapor phase corrosion and staining on a stainless steel surface in a clean in place process, the method comprising:

(a) applying a vapor phase corrosion inhibited acid cleaning composition to a stainless steel surface, the composition comprising an acid cleaning solution in contact with the stainless steel surface and a vapor phase corrosion inhibitor and up to 4 weight percent urea at a composition temperature range of about 40 degrees Fahrenheit to about 200 degrees Fahrenheit.

2. The method of claim 1, wherein the vapor phase corrosion inhibited acid cleaning composition comprises about 0.05 wt. % to about 5 wt. % vapor phase corrosion inhibitor.

3. The method of claim 2, wherein the vapor phase corrosion inhibitor comprises of an ethoxylated amine, ethoxylated alcohol or combinations thereof.

4. The method of claim 1, wherein the acid cleaning solution comprises at least one of sulfuric acid diluted with water at a concentration up to 30 wt. % or nitric acid diluted with water at a concentration up to 25 wt. % or mixtures thereof.

5. The method of claim 1, wherein the vapor phase corrosion inhibited acid cleaning composition comprises about 1 wt. % to about 50 wt. % of a sulfuric/nitric blended acid cleaning solution in water.

6. The method of claim 1, wherein the vapor phase corrosion inhibited acid cleaning composition comprises about 5 wt. % to about 50 wt. % nitric acid or about 1 to about 30 wt. % sulfuric acid or mixtures thereof.

7. The method of claim 1, wherein the vapor phase corrosion inhibited acid cleaning composition comprises about 1 wt. % to about 80 wt. % water.

8. The method of claim 1, wherein the composition is in a concentrated form that may be diluted to a usable cleaning solution concentration.

9. The method of claim 1, wherein the vapor phase corrosion inhibited acid cleaning composition comprises about 0.01 wt. % to about 5 wt. % surfactant.

10. The method of claim 9, wherein the surfactant is a non-ionic surfactant, and/or a cationic surfactant or mixtures thereof.

11. The method of claim 1, wherein the composition is substantially free of a metallic ion or a phosphorus compound.

12. A vapor phase corrosion inhibited acid cleaning composition for inhibiting corrosion and staining on a stainless steel surface in a clean in place process, the composition comprising:

(a) about 0.05 wt. % to about 5 wt. % vapor phase corrosion inhibitor;

(b) about 5 wt. % to about 50 wt. % nitric acid or about 1 wt. % to about 30 wt. % sulfuric acid or mixtures thereof;

(c) up to about 4 wt. % urea; and (d) about 1 wt. % to about 80 wt. % water.

13. The composition of claim 12, wherein the composition is in a concentrated form that may be diluted to a usable cleaning solution concentration.

14. The composition of claim 12, wherein the vapor phase corrosion inhibitor comprises of an ethoxylated amine, ethoxylated alcohol or combinations thereof.

15. The composition of claim 12, wherein the composition further comprises about 0.01 wt. % to about 5 wt. % surfactant.

16. The composition of claim 15, wherein the surfactant is a non-ionic surfactant, cationic surfactant or combinations thereof.

17. The composition of claim 12, wherein the composition is substantially free of a metallic ion or a phosphorus compound.

18. A method of cleaning a stainless steel surface on industrial equipment in a clean in place process by contacting the vapor phase corrosion inhibited acid cleaning composition of claim 12 directly to the stainless steel surface at a temperature range of about 40 degrees to about 200 degrees Fahrenheit.

* * * * *